United States Patent [19]

Schurter et al.

[11] Patent Number: 4,732,319

[45] Date of Patent: Mar. 22, 1988

[54] FILL VALVE FOR A WATER HEATING SYSTEM

[75] Inventors: Robert M. Schurter, Elm Grove; Patrick J. Bourke, West Bend, both of Wis.

[73] Assignee: A. O. Smith Corporation, Milwaukee, Wis.

[21] Appl. No.: 63,821

[22] Filed: Jun. 19, 1987

[51] Int. Cl.[4] ..... F24D 3/00

[52] U.S. Cl. ..... 237/65; 137/505.18; 137/505.34; 237/66

[58] Field of Search ..... 237/65, 66; 137/505.18, 137/505.34

[56] References Cited

U.S. PATENT DOCUMENTS

| | | | |
|---|---|---|---|
| 2,721,576 | 10/1955 | Grove | 137/505.34 X |
| 2,920,647 | 1/1960 | Mercier | 137/505.18 |
| 3,089,513 | 5/1963 | Kirk | 137/505.34 |

*Primary Examiner*—Harold W. Weakley

*Attorney, Agent, or Firm*—Andrus, Sceales, Starke & Sawall

[57] ABSTRACT

A fill valve for a water heating system. An expansion tank is provided with a flexible diaphragm which divides the tank into a water chamber and a closed gas chamber. A fill valve assembly is mounted within an opening in the tank and includes a valve body having an axial passage and a radial passage connects the axial passage to a water inlet. One end of the axial passage communicates with the water chamber of the expansion tank, while the opposite end of the axial passage communicates with the water heating system. The central portion of the axial passage defines a valve seat and a hollow valve member is mounted for sliding movement in the axial passage, and the inner end of the valve member extends into the tank in position to be contacted by the diaphragm. Mounted on the valve member is an annular valve which is biased to engage the valve seat. A plurality of ports extends laterally of the valve member and provides communication between the inlet and the interior of the valve member. When the liquid in the water heating system expands, the diaphragm will be flexed inwardly causing the valve to be biased to a closed position to prevent water from entering through the inlet. When the volume of water in the heating system contracts, the diaphragm will flex outwardly moving the valve member within the valve body to open the valve and permit water to flow from the inlet to the heating system.

8 Claims, 4 Drawing Figures

FIG. 1
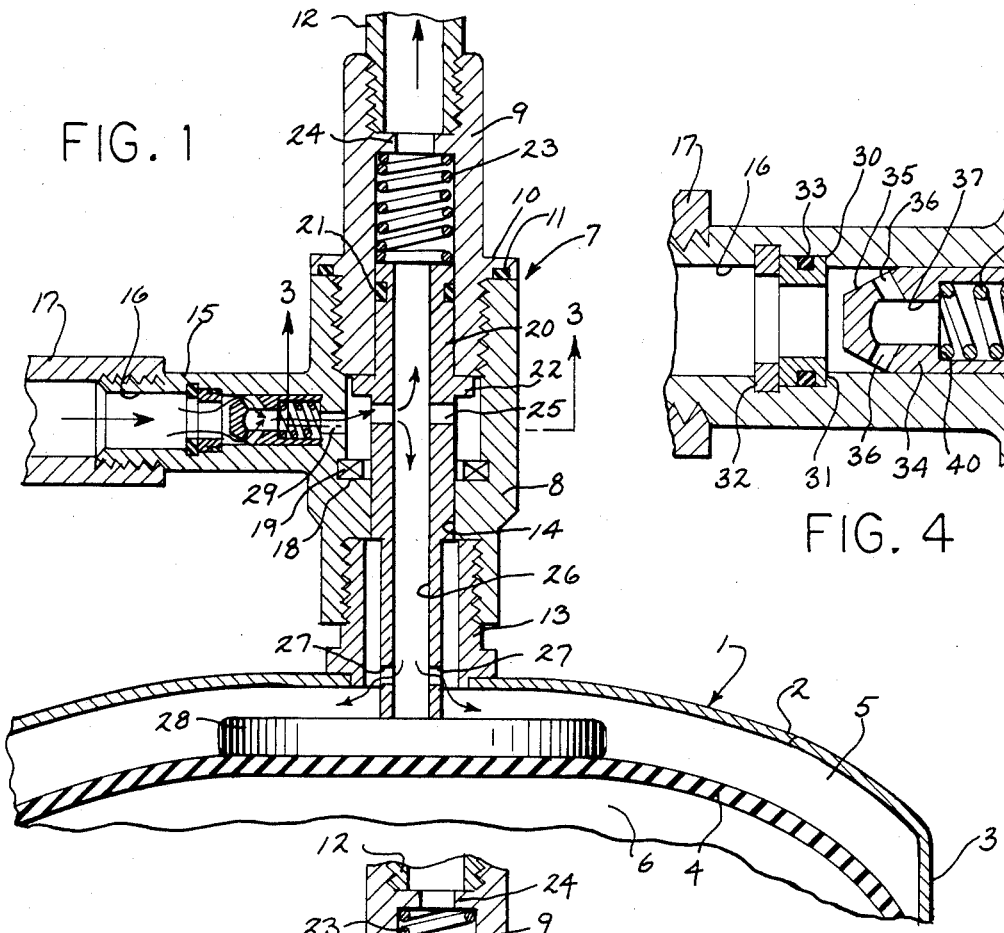
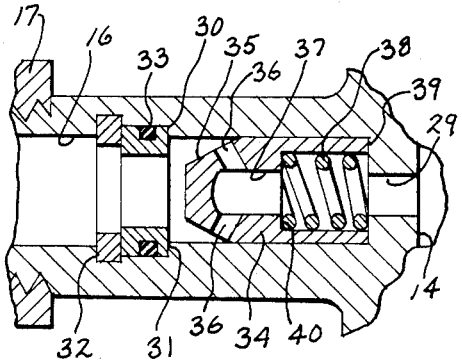
FIG. 4
FIG. 2
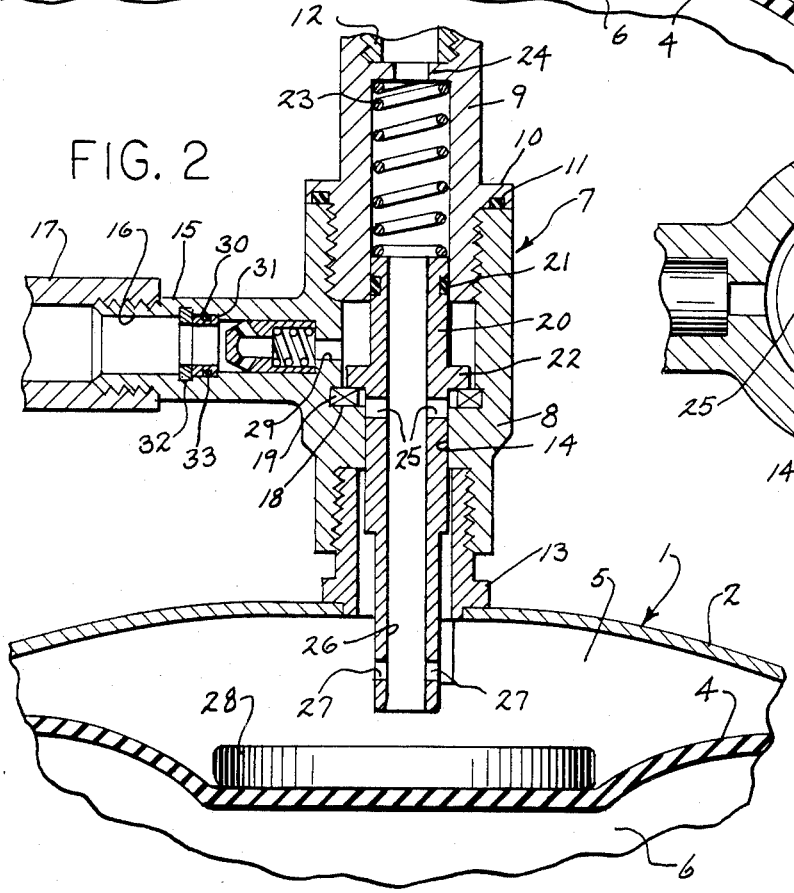
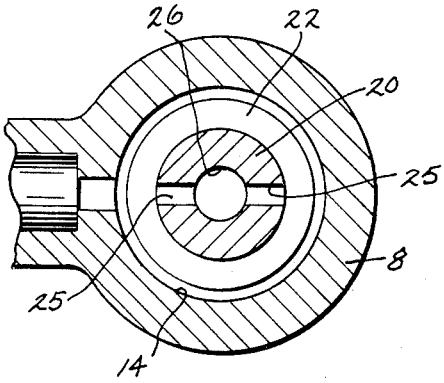
FIG. 3

FILL VALVE FOR A WATER HEATING SYSTEM

BACKGROUND OF THE INVENTION

Expansion tanks are used in hot water heating systems. During usage of the system, the volume of water will expand and contract and the variations in volume are created by the increase and decrease in the temperature of the boiler water as it is heated and cooled in the normal cyclic operation of the heating system.

The conventional expansion tank includes a flexible pressure member or diaphragm which divides the tank into a liquid chamber and a closed air chamber, and the air chamber provides a compressible cushion that compensates for the expansion and contraction of the volume of the water.

It is also known to combine a fill valve with an expansion tank in a hot water heating system, as described in U.S. Pat. No. 3,089,513. In the arrangement described in that patent, the fill valve, which controls the flow of incoming makeup water, is operated by movement of the diaphragm of the expansion tank. As the volume of liquid decreases, the diaphragm will flex outwardly and act to open the fill valve to admit additional quantities of makeup water. Conversely, as the volume of water increases, the diaphragm will flex inwardly, enabling the fill valve to close under the biasing action of a spring.

The fill valve assembly of U.S. Pat. No. 3,089,513 also includes a check valve in the inlet passage which permits the flow of makeup water into the valve assembly, but prevent flow in the opposite direction to thereby eliminate any possibility of the of the water in the heating system contaminating the fresh water supply.

SUMMARY OF THE INVENTION

The invention is directed to an improved and siimplified fill valve for a hot water heating system that is operated by movement of the diaphragm of the expansion tank. In accordance with the invention, the fill valve assembly includes a valve body mounted within an opening in the expansion tank and the body is provided with an axial passage, as well as a radial passage which provides communication between the axial passage and a source of makeup water. One end of the axial passage communicates with the water chamber of the expansion tank, while the opposite end of the axial passage defines an outlet that is connected to the water heating system.

Located centrally of the axial passage is a valve seat and a hollow valve member is mounted for sliding movement within the axial passage and is provided with an annular valve that is adapated to engage the seat.

The inner end of the valve member projects inwardly through the opening in the expansion tank in a position to be contacted by the diaphragm.

The hollow valve member is provided with a plurality of ports which are located axially inward from the valve and provide communication between the inlet passage and the interior of the valve member when the valve is in open position.

The valve is normally biased to a closed position, so that the ports will be closed and no makeup water will flow from the inlet through the hollow interior of the valve member to the outlet. As the volume of liquid in the water system contracts, the diaphragm will flex upwardly engaging the lower end of the valve member to open the valve and permit makeup water to enter the water heating system. Conversely, when the volume of water increases, the diaphragm will flex downwardly and the valve will be biased to a closed position.

The invention also includes a check valve in the inlet passage, which permits flow of makeup water to the valve, but prevents flow in the opposite direction, thereby preventing water in the water heating system from entering and possibly contaminating the makeup water supply.

Other objects and advantages will appear in the course of the following description.

DESCRIPTION OF THE DRAWINGS

The drawings illustrate the best mode presently contemplated of carrying out the invention.

In the drawings:

FIG. 1 is a vertical section of the fill valve as associated with an expansion tank and showing the valve in an open position;

FIG. 2 is a view similar to FIG. 1 showing the valve in a closed position;

FIG. 3 is a section taken along line 3—3 of FIG. 1; and

FIG. 4, is a fragmentary enlarged view of a portion of FIG. 2 and showing the check valve construction.

DESCRIPTION OF THE ILLUSTRATED EMBODIMENT

FIG. 1 shows a portion of an expansion tank 1 for a hot water heating system which includes an upper head 2 and a cylindrical shell 3. A flexible pressure member or diaphragm 4 is connected to the shell 3 and divides the tank into an upper liquid or water chamber 5 and a lower closed air chamber 6. The air contained within chamber 6 provides a cushion to accommodate expansion and contraction of the volume of water in the heating system in a conventional manner.

Mounted on the outer surface of head 2 is a fill valve assembly including a body 7 composed of an inner section 8 and an outer section 9. Outer section 9 is provided with an outwardly extending annular flange or shoulder 10 which is disposed in engagement with the outer end of section 8 and the joint between shoulder 10 and the end of body section 8 is sealed by an O-ring seal 11 that is mounted within a groove in flange 10.

Water is discharged from outer section 9 through a pipe 12 which is threaded within an opening in section 9. Pipe 12 is connected to the heating system of the building to be heated.

As shown in FIG. 1, an externally threaded nipple 13 is secured to tank head 2 bordering an opening in the head and the inner end of body section 8 is threaded to the nipple.

Valve body 7 is provided with an axial passage 14 with the outer end of the axial passage communicating with outlet pipe 12; while the inner end of the passage is in communication with the water chamber 5 of expansion tank 1.

Extending radially from body section 8 is an extension 15 which defines an inlet passage 16. An inlet pipe 17 connected to a source of makeup water is threaded onto the outer end of extension 15.

Located centrally of axial passage 14 is a shoulder or ledge 18 which supports an annular valve seat 19. An elongated hollow valve member 20 is slidable within passage 14 and the outer end of valve member 20 is sealed to the internal wall of body section 9 by an O-ring seal 21 that is mounted within a circumferential groove in the outer surface of valve member 20.

Located generally midway of the length of valve member 20 is an outwardly extending flange or shoulder 22 which defines a valve that is adapted to engage seat 19. Valve 22 is biased into engagement with seat 19 by a compression spring 23 which is mounted within passage 14. One end of spring 23 bears against the outer end of valve member 20, while the outer end of spring 23 bears against an annular ledge 24 formed in body section 9. With this arrangement, the force of spring 23 will urge valve 22 to a closed condition against seat 19.

Positioned immediately inward of the valve 22 are ports 25 which extend radially through the valve member and provide communication between passage 14 and the central passage 26 in valve member 20. A pair of ports 25 are illustrated, but it is contemplated that one or more ports may be employed.

In addition, a pair of ports 27 are formed in the inner end of valve member 20 and provide communication between the central passage 26 and chamber 5 of expansion tank 1.

When diaphragm 4 is flexed inwardly due to the expansion of water in the system, the inner end of valve member 20 will be out of contact with the disc 28 attached to diaphragm 4 and spring 23 will urge the valve 22 to a closed condition, as shown in FIG. 2. When the volume of water contracts, diaphragm 4 will be flexed outwardly causing the disc 28 to engage the inner end of valve member 20, thereby opening valve 22 and permitting inlet water to flow from inlet passage 16 through hole 29 into passage 14 and then through ports 25 in valve member 20 to central passage 28. The makeup water can then flow through the outlet pipe 12, as well as entering the chamber 5 of expansion tank 1 through ports 27, as shown in FIG. 1.

The invention also includes a check valve mechanism in the inlet passage 16 which will prevent the flow of water from the heating system back into the makeup supply. In this regard, an annular valve seat 30 is mounted in inlet passage 16 against an internal shoulder 31 and is retained against the shoulder by a retaining ring 32. The interface between seat 29 and the inner wall of extension 15 is sealed by an O-ring seal 33, which is mounted within a groove in valve seat 30. A check valve 34 is mounted for movement in inlet passage 16 and is adapted to engage seat 30 to close the inlet passage. Valve 34 is provided with a tapered end 35 that engages seat 30 and a pair of openings 36 extend through the wall of the valve communicating with a central passage 37. Valve 34 is biased to a closed condition by a spring 38, one end of which bears against a shoulder 39 at the end of the inlet passage 16, while the opposite end bears against a shoulder 40 formed in valve 34. The pressure of the makeup water will normally retain valve 34 to an open condition. However, if for some reason the pressure in the water heating system exceeds the pressure of the makeup water, valve 34 will move to a closed position to prevent flow of the water from the heating system into the makeup water source.

The invention provides a simple and effective fill valve assembly which is actuated by the diaphragm of the expansion tank. Valve 22 is normally biased to a closed condition and as the diaphragm flexes upwardly on contraction of the volume of water in the heating system, the valve will be moved to an open condition to enable makeup water to pass through ports 26 into the interior of the valve member 20 and then into the water system.

Various modes of carrying out the invention are contemplated as being within the scope of the following claims particularly pointing out and distinctly claiming the subject matter which is regarded as the invention.

I claim:

1. A liquid control mechanism for a liquid heating system, comprising an expansion tank having a flexible pressure member dividing the tank into a liquid chamber and an enclosed gas chamber, a fill valve assembly mounted on the tank and including a body having an axial passage and having a second passage communicating between the axial passage and a source of makeup liquid, one end of said axial passage communicating with said liquid chamber and the opposite end of said axial passage defining an outlet and communicating with a water heating system, a portion of said axial passage defining a valve set, a hollow valve member mounted for sliding movement in said axial passage and having an inner end projecting through said opening into said tank and positioned to be contacted by said pressure member, said valve member having a valve disposed to engage said seat, and port means extending laterally in said valve member and providing communication between said second passage and the interior of said valve member, said port means being constructed and arranged so that when said valve is engaged with said seat, said port means is out of communication with said second passage and when said valve is disposed out of engagement with said seat said port means communicates with said second passage to permit water from said second passage to pass into the interior of said valve member and then to said outlet.

2. The mechanism of claim 1, wherein said valve seat is generally flat and disposed in a plane normal to the axis of said axial passage.

3. The mechanism of claim 2, wherein said valve comprises a shoulder extending laterally from said valve member and having a flat valve surface disposed to flatwise engage said seat.

4. The mechanism of claim 1, and including biasing means to bias the valve to a closed position.

5. The mechanism of claim 1 and including second port means disposed in the inner end of said valve member and providing communication between the interior of said valve member and said liquid chamber.

6. The mechanism of claim 1 and including a generally rigid pad on said pressure member and disposed to engage the inner end of said valve member.

7. A liquid control mechanism for a liquid heating system, comprising an expansion tank having a diaphragm dividing said tank into a liquid chamber and a closed gas chamber, a fill valve assembly mounted in communication with an opening in said tank and having an axial passage and a second passage providing communication between said axial passage and a source of makeup liquid, one end of said axial passage communicating with said liquid chamber and the opposite end of said axial passage defining an outlet and communicating with a water heating system, a valve seat disposed generally centrally of the length of said axial passage, a hollow valve member mounted for sliding movement in said axial passage and extending through said opening into said liquid chamber and being engageable with said diaphragm when said diaphragm is flexed outwardly, said valve member including an annular valve disposed to engage said seat, biasing means for biasing said valve in engagement with said seat, said valve member including at least one port located in said valve member and disposed immediately inward in a direction toward said tank from said valve, said port providing communication between said second passage and the interior of said valve member, and means responsive to outward flexing of said diaphragm for moving said valve member in said axial passage to move said valve out of engagement with said seat and move said port into registry with said second passage to enable makeup liquid to flow from said second passage through said port into the interior of said valve member and then through said outlet to said water heating system.

8. The mechanism of claim 7, and including check valve means disposed in said second passage for permitting free flow of liquid form said source to said axial passage, but preventing flow of liquid in the opposite direction.

* * * * *